United States Patent [19]

Wolf et al.

[11] 4,140,406

[45] Feb. 20, 1979

[54] DOT MATRIX PRINT HEAD

[75] Inventors: Peter H. Wolf, Campbell; Boyd E. Slade, Sunnyvale, both of Calif.

[73] Assignee: Dataproducts, Santa Clara, Calif.

[21] Appl. No.: 805,706

[22] Filed: Jun. 13, 1977

[51] Int. Cl.[2] ..... B41J 3/12

[52] U.S. Cl. ..... 400/124; 101/93.05

[58] Field of Search ..... 197/1 R; 101/93.05, 101/93.48; 400/124

[56] References Cited

U.S. PATENT DOCUMENTS

| | | | |
|---|---|---|---|
| 3,882,986 | 5/1975 | Howard | 197/1 R |
| 3,897,865 | 8/1975 | Darwin et al. | 197/1 R |
| 3,900,094 | 8/1975 | Larsen et al. | 101/93.05 X |
| 3,929,214 | 12/1975 | Hebert | 197/1 R |
| 3,991,869 | 11/1976 | Berrey | 197/1 R |
| 4,009,772 | 3/1977 | Glaser et al. | 197/1 R |
| 4,044,668 | 8/1977 | Barrus et al. | 101/93.48 X |
| 4,049,108 | 9/1977 | Giessner | 197/1 R |

*Primary Examiner*—Paul T. Sewell

[57] ABSTRACT

A printing head for forming dot matrix characters which includes a wire stylus assembly having a plurality of guide bearings spaced to reduce the wear of the tip bearing, and to minimize buckling and resonances. Each stylus is driven by an electromagnetic actuator having a hinged armature, with the stylus drive point at the center of percussion of the armature with respect to the hinge line. Damping is effected at the same point. The armatures are shaped to drive the styli directly in line with the stylus wires without introducing a moment. Individual adjustments for magnetic gap are provided. A retainer device for holding all of the armatures in place during assembly is also provided.

11 Claims, 7 Drawing Figures

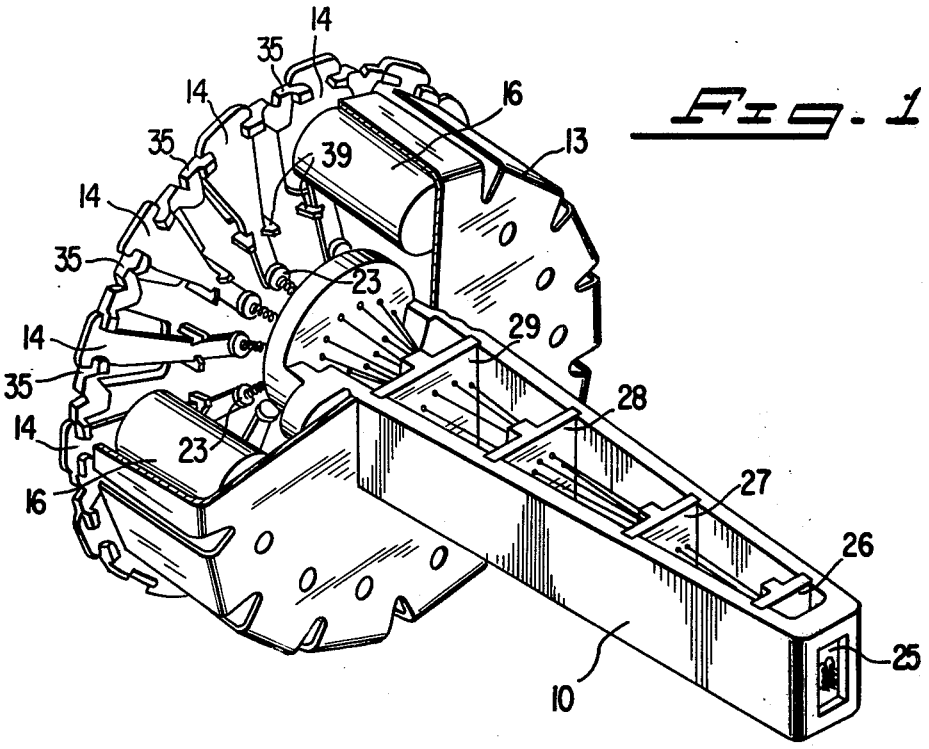
Fig. 1
Fig. 5
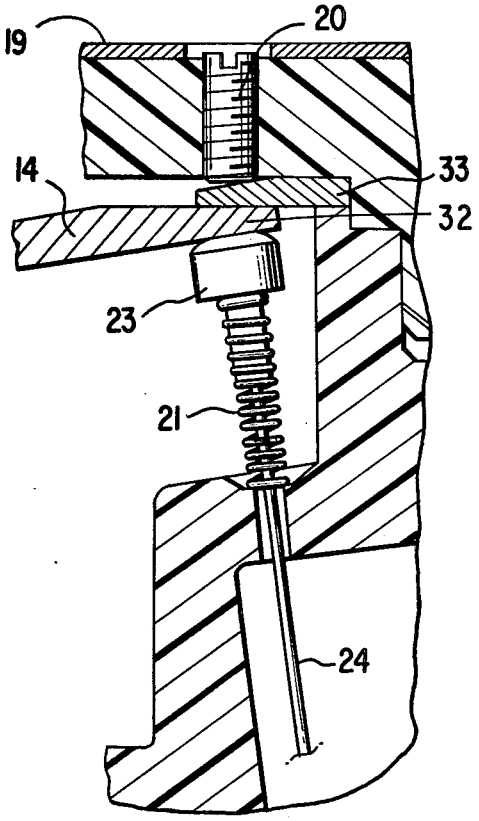
Fig. 6
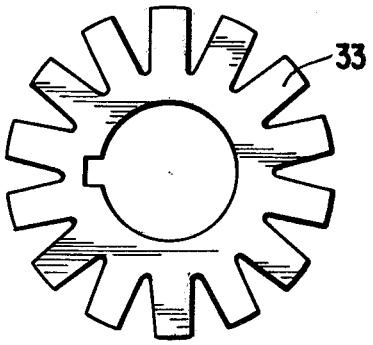

Fig. 2
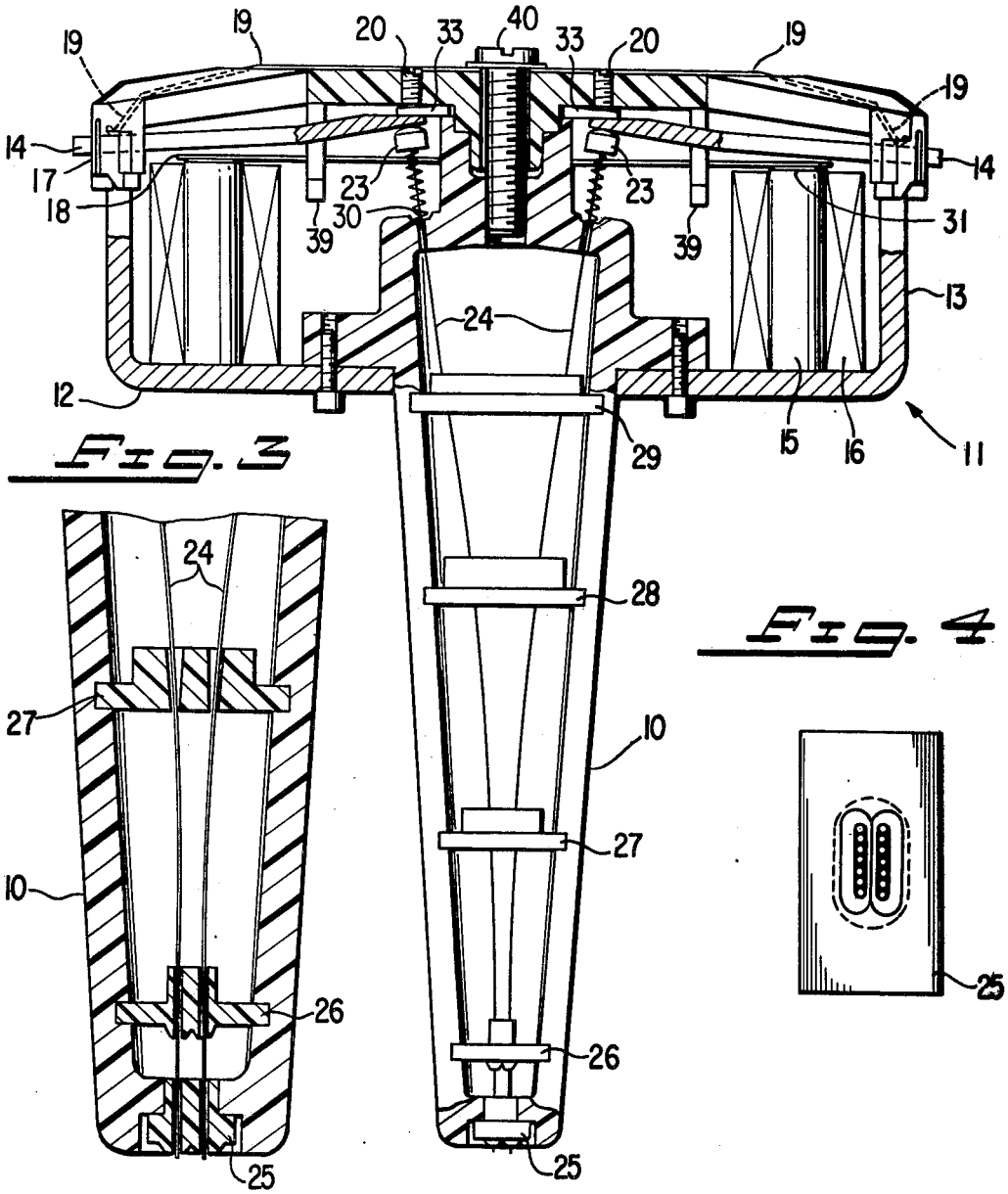
Fig. 3
Fig. 4
Fig. 7
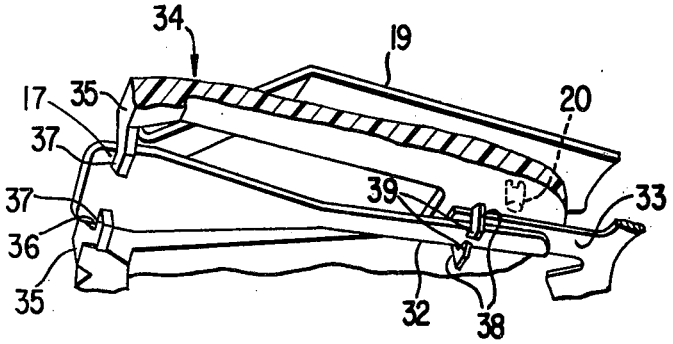

DOT MATRIX PRINT HEAD

BACKGROUND OF THE INVENTION

1. Field of the Invention

This invention relates to the field of dot matrix print heads.

2. Description of the Prior Art

Printing characters by the dot-matrix method commonly involves the use of a printing head wherein a plurality of printing styli are arranged in a vertical column, and spaced apart a distance equal to the vertical distance between rows of the matrix. It is often the case that the distance between rows is equal to the stylus wire diameter and in such a case, the wires are actually touching. The stylus array is rapidly moved across a printing medium and the styli selectively actuated by electromagnetic means to form groups of dots which convey the form of the desired character. There may be, for example, 7 styli in the vertical column spaced about 0.014 inches apart so as to print characters about 0.100 high. Each character may consist of dots selected from a matrix 7 dots high × 7 dots wide.

It is obviously impractical to construct electromagnetic actuating structures small enough to be spaced 0.014 inches apart, so what has evolved in the art is the use of long (typically about 3½ inches) styli which are gradually curved so that the remote ends are far enough apart to allow them to be driven by reasonably sized actuators. Actuators are distributed in a manner which minimizes the curvature of the styli, typically in a circular pattern, the driven ends of the styli being near the center of the circle.

While practical, there are a number of problems associated with the above described configuration, and some of these problems are exacerbated when the number of styli is increased, as for example, in the case of an array of 14 styli in two columns. Increasing the number of styli to 14 can be advantageous in many instances since substantially higher writing speeds can be achieved with a two column configuration, but the additional curvature of the wire needed and the generally larger units, make the wire driving and guiding a more difficult matter.

SUMMARY OF THE INVENTION

The invented print head is described herein as a 14 stylus head having a number of novel features which cooperate to yield a head capable of extremely high speed operation with an extended life and high reliability.

The printing head includes a group of 14 electromagnetic actuators grouped in a circular arrangement with the hinge ends of the armatures near the periphery of the circle and the free ends near the center of the circle. The free ends of the armatures drive the styli which, in a presently preferred embodiment, are about 0.014 inches in diameter and about 3.5 inches long. The stylus wires curve gently from their generally circular distribution at the driven end to the double columnar arrangement at the tip end. Guide bearings are provided at selected places along the length of the wires to assure that resonances in the wires will not be excited as the styli are actuated, and to prevent any tendency of the wire to buckle.

The driven end of each stylus is spring loaded and contacts its associated actuator armature at the center of percussion with respect to the hinge line thus keeping wear to a minimum.

The armature is shaped so that it contacts the enlarged driven end of the stylus in line with the stylus wire so that no moment is created which would have a tendency to buckle the wire. Friction between the wire and the bearing is also minimized.

After removal of excitation from the electromagnetic actuator, the armature is driven upward by the spring loaded stylus and strikes a pad of lossy rubber like material which absorbs the kinetic energy of motion and stops the armature without a bounce. The damper is effective at the center of percussion of the armature. An adjusting screw behind each damper pad allows the magnetic gaps of the actuators to be adjusted individually.

BRIEF DESCRIPTION OF THE DRAWINGS

FIG. 1 is a perspective view of the invented print head partially broken away to show the relationship between the parts.

FIG. 2 is a cross sectional view thereof.

FIG. 3 is an enlarged cross sectional view of the tip end of the stylus assembly.

FIG. 4 is an end view of the stylus assembly showing the columnar format of the print wires.

FIG. 5 is an enlarged side view of the area including the tip end of one of the armatures.

FIG. 6 is a plan view of the damper.

FIG. 7 is a perspective view of a single section of a loaded armature retainer broken away, and looking from below.

DETAILED DESCRIPTION OF THE PREFERRED EMBODIMENTS

Referring first to FIG. 2 which is a cross sectional view of the invented print head, there can be seen a wire guide housing 10 on which is mounted the actuator assembly 11. The section cuts through two of the actuators, and the relationships between the wire styli, guides, and actuators can best be seen in this view. The stationary magnetic structure 12 is common to all of the actuators, being comprised of a flat plate of magnetic material with ears 13 bent up to form heels on which the actuator armatures 14 ride. Pole pieces 15, surrounded by coils 16 supply the magnetic field required to operate the actuators.

Since substantial force must be generated by the actuators in order to print satisfactorily, and it is desirable that little electrical power be consumed in the process, the magnetic gaps must be kept quite small. The gaps also must be uniform in order that the forces applied to the styli exhibit but little variation, and the resultant printed text have a uniform character. The gaps cannot, however, be allowed to become zero since the residual induction in the magnetic structure under zero gap conditions may prevent the actuator from releasing. Accordingly, the faces of pole pieces 15 and hinge surfaces 17 are ground in a single operation to form a plane and spacer 18, which is fabricated from some thin nonmagnetic material, for example 3.5 mil polymide film is placed over the face of pole pieces 15 to assure that there will always be some magnetic gap.

The heel ends of armatures 14 are urged toward hinge surfaces 17 by leaf spring 19, and the tip ends urged toward adjusting screws 20 by coil springs 21. Energization of any of the coils 16 causes the associated armatures to be attracted by pole pieces 15, driving wire styli 24 through their enlarged driven ends, buttons 23 to impact on the printing medium.

Buttons 23 are molded on the ends of styli 24 and have a hemispherical surface in the area of contact with armatures 14. Coil springs 21 urge the buttons 23 against the armatures 14 and cause the styli to retract after operation.

The styli pass through a series of guides 25, 26, 27, 28, 29 and 30 and gently converge to the two column form which can be seen in the end view of the printing head shown in FIG. 4.

The guides 27, 28, 29 and 30 while appearing thick in the drawing, have apertures therein which are tapered so that the guides are a close fit to the wires only in a small region near the tip end of each bearing. Guides 25 and 26 have cylindrical apertures with identical patterns which hold the wires straight and square with the axis of the printing head as they pass therethrough. The wire therefore is curved like a beam fixed at one end (at guide 26) and subject to a concentrated load at the other end (at guide 30).

The path of the styli between guide 26 and guide 30 is substantially that which it would have if guides 27, 28 and 29 were not present, the guides 27, 28 and 29 being positioned so as not to alter the natural contours of the wires. The purpose of the guides is to control buckling and reduce resonances.

One consequence of the wires being straight passing through guide 26, and there being no bending moments introduced by guides 27, 28, 29 and 30, is that the curvature of the wire varies along its length, being least near guide 30 and most near guide 26. This is advantageous since curvature near the driven end of the styli results in a greater tendency of the wire to buckle.

For best performance, the axial positioning of guides 27, 28 and 29 is critical. It will be appreciated that the present invention is intended for high speed operation, each stylus being capable of printing about 1000 dots per second in a presently preferred embodiment. Under such circumstances, the long unsupported length of each stylus results in some buckling of the wires as the wire impacts on the printing medium. If the guides were equally spaced, transverse resonances of the wires would severly limit the speed of operation.

The actual dimensions of the presently preferred embodiment which has been particularly efficacious in eliminating resonances are as follows (from the tip end faces of each bearing):

26 - 27 = 0.77 inches
26 - 28 = 1.57 inches
26 - 29 = 2.22 inches
26 - 30 = 2.73 inches Each of the bearing guides is about one-eighth inch thick, however, bearing guides 27 through 30 have tapered apertures therein which are a close fit to the styli only near the tip ends of the bearings. The above given dimensions can vary up to ¼ inches without causing such a severe increase in resonances as to result in lower speed capability.

The length of the wires can be increased or decreased somewhat, and the minimum resonance state retained by keeping the spacings in about the same ratios. That is, if the spacing 26 - 30 is taken as 1, then the other spacings are as follows:

26 - 27 = 0.28
26 - 28 = 0.58
26 - 29 = 0.81
26 - 30 = 1

It would, of course, be possible to increase the number of intermediate guide bearings to increase the natural frequency of the resonances and make them less troublesome, but the added expense and added friction involved makes it desirable to keep the number of guide bearings to a minimum.

The hole pattern in guides 25 and 26 are identical and the apertures are cylindrical and a close fit to the wires. As a result, the styli are straight as they pass through and between these guides. The purpose for this construction is that there is a certain side load on the guides at the ends of the curved portions of the styli which is caused by the styli trying to straighten. Over the life of the printing head (which may include more than 300,000,000 actuations of a single stylus wire) a guide bearing which endures such a side force will tend to wear, and allow the wires to change relative position. If the tip bearing 25 carried the above described side load, the wear and consequent shifting of the wires would result in deformed characters. By providing a guide 26 close to guide 25 to carry the side load, the wires will be straight as they pass through guide 25, and the wear on guide 25 will be substantially reduced, thereby extending the useful life of the print head. As an example, in a preferred embodiment of the invented print head, the stylus wires are 0.014 inches in diameter, and pass through holes in guides 25 and 26 0.015 inches in diameter, the guides 25 and 26 each being 0.140 inches thick and spaced 0.100 inches. Bearing guides of filled nylon having these dimensions have a life of more than 300,000,000 operations.

The button ends of the stylus wires emerge from guide 30 at an angle to the axis of the print head, which is about 8 degrees in the preferred example of the head herein described. Since the magnetic gap between armature 14 and pole piece 15 must be kept as small as practical in order to keep the magnetic efficiency and available force high, the angle which the armature makes with the plane through the hinge surface 17 and pole piece top surface 31 is limited to just a few degrees, being in the example described herein, about 1.1 degrees. If the armature 14 were flat, as is usual in the art, the armature would contact button 23 at a point other than top center, that is, the point on the button surface directly in line with the wire styli. This misalignment results in a moment with respect to the wire, and an increased tendency of the wire to buckle. In the invented print head, the bottom surface of the armature at its tip end 32 is bent upward so that it meets the button 23 at top center, eliminating the undesirable moment.

The top surface of tip end 32 of the armatures rests against damper 33, a star shaped disc of rubber-like material having high internal losses. Silicone rubber compounds have been found to be a suitable material for this component. The preferred configuration of damper 33 can be seen in FIG. 6 as having a plurality of spokes which correspond to the actuators, one spoke being located above each armature. A plurality of adjusting screws 20, one for each actuator, bear against the backs of the dampers 33, directly above each point of contact of button 23 with armature 14. This permits individual adjustment of the working magnetic gaps of the actuators, in contrast with a single adjustment for all armatures which is common in the prior art. In order to obtain the maximum damping effect, the top surface of armature tip end 32 is flattened to make square contact with damper 33.

The location of the point of contact of the elements just described, i.e., damper 33, armature 14, adjusting screw 20, and button 23 is critical. One problem that has plagued the industry in the past is excessive wear at the hinge 17. In order to be useful, the actuators of a dot matrix print head must be capable of upwards of 300,000,000 operations without maintenance and it will be appreciated that relatively small and obscure forces can cause large reductions in life when so many actuations are contemplated. The importance of the interrelationships between the armature, the damping means, and the stylus has been previously overlooked and thereby the potential life of prior art units has not been realized. The motion of the styli 24 in normal operation is typically 0.015 inches and, as previously stated, they may be capable of 1000 operations per second. It can be seen that substantial velocities are involved in the operation of the actuators, and that there are two points in the printing cycle which involve very abrupt changes in velocity, namely upon stylus impact on the paper, and upon the armature striking the damper on return.

Of the two, the armature striking the damper is the most significant in the presently preferred embodiment of the invention. In some prior art print heads the impact of the armature on the damper has caused premature wear on the hinge due to the reaction effect. In the invented print head, the design of the armature is such that the center of percussion of the armature with respect to the hinge line falls within the area of contact of the armature and the damper. Consequently, this impact causes no reaction of the hinge line and results in longer life.

To a lesser degree, in the presently preferred embodimnent of the invention, but nevertheless of significance, the impact when the stylus strikes the printing medium has the capability of causing wear at the hinge line. By locating the contact between the stylus and the armature in the region of the center of percussion, this effect is also nullified.

Maintaining all of the parts of a multiactuator print head in their proper positions during assembly has always posed a problem for those assigned the job of assembling print heads. For example, the armatures are usually positioned on the stationary magnetic assembly while the damping and other components are installed. Since the armatures are loose, it is difficult to assemble the rest of the components without jarring one or more of the armatures out of place. In the present invention a snap in armature retainer is provided which holds all of the armatures together with the damping components, so that installation is simple. The armature retainer 34 which is generally disc-like with a plurality of radial spokes, includes a series of projections and lips at each armature position in which the armatures may be rested during the assembly of the print head.

At the periphery of the retainer 34 are depending projections 35 which are a loose fit to grooves 36 in the armatures 14. The diameter of the circle formed by all of the inner surfaces of projections 35 is slightly larger than the outer diameter of the circle formed by ears 13 of the stationary magnetic structure 12 so that upon assembly, retainer 34 will just fit over the stationary magnetic structure. The base ends of the armatures 14 rest on lips 37 extending from projections 35. Projections 38 with lips 39 support the tip ends 32 of the armature.

To assemble the armatures to the actuator, it is only necessary to lay the armatures on the lips 37 and 38 at each position and fit the loaded armature retainer over ears 13. The armature retainer is held in place by a single screw 40 on the axis of the print head which also holds leaf spring 19. The projections 35 and 38 are long enough so that after assembly lips 37 and 39 no longer contact the armatures 14 and the armatures are free to operate.

I claim:

1. In a dot matrix print head which includes a plurality of electromagnetically actuated impact printing styli and wherein the actuation means includes elongated armatures having a free end and an opposite end rotating about axes to axially drive said styli, the improvement which comprises:

a member of rubber-like material having a plurality of radially extending members, one of said radially extending members being positioned adjacent the free end of said armatures; and an adjustable member positioned behind each of said radially extending members in the area of contact with said armature whereby the working magnetic gap of each of said electromagnetically actuated styli can be adjusted independently.

2. In a dot matrix print head as recited in claim 1 having a bearing assembly for guiding the styli wherein there are first through fourth intermediate guide bearings, and wherein the ratio of the distances between said first intermediate guide bearing and said second through fourth intermediate guide bearings, with respect to the distance from said first intermediate guide bearing to said driven end bearing are about 0.28, 0.5 and 0.81 respectively.

3. The assembly as recited in claim 2 wherein said second through fourth intermediate guide bearings and said driven end guide bearing, are spaced from said first intermediate guide bearing by about 0.77, 1.57, 2.22 and 2.73 inches, respectively.

4. The wire stylus assembly as recited in claim 3 where said second through fourth intermediate guide bearings are about one-eighth inch thick.

5. A dot matrix printing head which comprises:

a. a wire stylus assembly including:

(i) a plurality of wire styli each having a driven end terminating in an enlarged button having a substantially hemispherical surface, and a tip end, and (ii) a plurality of guide bearings guiding said styli between said driven end and said tip end; and b. an actuator assembly including:

(i) a magnetic base having a plurality of ears forming a substantially circular pattern around an axis, one of said ears being associated with each of said styli, (ii) a plurality of pole pieces each having at least one face in a circular pattern around said axis inside said ears, (iii) a coil on each of said pole pieces, (iv) a plurality of armatures, each having a base end resting on each of said ears, and having a tip end resting on the driven end of a styli; and (v) damping means contacting each of said armatures substantially at the center of percussion of said armature with respect to the line of contact of said armatures with said ears, said damping means made from a rubber like material in the form of a spoked disc having a plurality of spokes and means for individually moving the position of said spokes behind each of said armatures in the direction of motion of said armature.

6. The dot matrix printing head as recited in claim 1 where said driven ends of said stylus contact said armatures substantially at said center of percussion.

7. The dot matrix printing head as recited in claim 1 where said means for individually moving the position of said spokes is comprised of a plurality of screws threaded through a member attached to said actuator assembly, one of said screws being positioned behind each of said spokes.

8. The dot matrix printing head as recited in claim 1 where a portion of said ears and the faces of said pole pieces are in a plane and the tip ends of said armatures are bent up whereby said armatures contact said styli at the point of extension of the axes of said styli.

9. In a dot matrix print head which includes a plurality of electromagnetically actuated impact printing styli and wherein the actuation means includes elongated armatures having a free end and an opposite end rotating about hinge axes to axially drive said styli, the improvement which comprises:

a flat disc of rubber-like material having radially extending spokes, one of said spokes being positioned over the free end of each of said armatures; and an adjusting screw positioned behind each of said spokes in the area of contact with said armature whereby the working magnetic gap of each of said electromagnetically actuated styli can be adjusted independently.

10. A dot matrix print head which comprises:

a. a plurality of stylus wires arranged in a circle at one end thereof, and in two columns at the other ends thereof, each of said styli terminating in an enlarged end, each of said enlarged ends having a substantially hemispherical surface for application of force;

b. a plurality of guide bearings between the ends of said styli supporting said styli against buckling;

c. a plurality of electromagnetic actuators each having an elongated armature rotatable about a hinge axis for axially driving said styli through said enlarged ends, the surface of said armatures bearing against said enlarged end being perpendicular to the axis of said styli in the region of said enlarged ends whereby the force applied by said armatures to said enlarged ends will be at a point collinear with the axis of said styli;

d. a plurality of coil springs urging said buttons against said armatures;

e. damping means comprised of a disc of rubber-like material having a plurality of radial spokes, a region including the center of percussion with respect to said hinge axis of each of said armatures being in substantially flat contact with one of said spokes when said armature is unactuated; and f. a plurality of screws, one bearing against the back of each of said spokes in the area of contact between said spokes and said armatures, whereby said electromagnetic actuators can be individually adjusted.

11. A dot matrix print head as recited in claim 10 wherein said plurality of guide bearings comprises a tip end guide bearing, first through fourth intermediate guide bearings, and a driven end guide bearing, and the distance from the said first intermediate guide bearing to said second, third and fourth intermediate guide bearings and said driven end bearing is about 0.77, 1.57, 2.22 and 2.73 inches, respectively.

* * * * *